United States Patent [19]

Groothuis et al.

[11] 4,424,628

[45] Jan. 10, 1984

[54] SHAVING APPARATUS

[75] Inventors: Gerrit J. Groothuis; Eduard W. Tietjens, both of Drachten, Netherlands

[73] Assignee: U.S. Philips Corporation, New York, N.Y.

[21] Appl. No.: 397,320

[22] Filed: Jul. 12, 1982

Related U.S. Application Data

[63] Continuation of Ser. No. 85,158, Oct. 15, 1979, abandoned.

[30] Foreign Application Priority Data

Nov. 21, 1978 [NL] Netherlands ..... 7811437

[51] Int. Cl.[3] ..... B26B 19/64

[52] U.S. Cl. ..... 30/43.92; 30/346.51

[58] Field of Search ..... 36/34.2, 43.4–43.92, 36/346.51; 76/104 R

[56] References Cited

U.S. PATENT DOCUMENTS

| | | | |
|---|---|---|---|
| 3,088,205 | 5/1963 | Ellis | 30/43.6 X |
| 3,962,784 | 6/1976 | Tietjens | 30/346.51 X |
| 4,261,101 | 4/1981 | Tietjens et al. | 30/43.92 |

*Primary Examiner*—James G. Smith

*Attorney, Agent, or Firm*—Rolf E. Schneider

[57] ABSTRACT

A shaving apparatus comprising a shear plate and an associated reciprocatory cutting member is provided with cutting elements each of which is constituted by a filamentary cutter positioned along the outer edge of a lamelliform support.

2 Claims, 8 Drawing Figures

SHAVING APPARATUS

This is a continuation of application Ser. No. 085,158, filed Oct. 15, 1979 now abandoned.

This invention relates to a shaving apparatus having a shear plate with hair entry apertures and a cutting member which is drivable relative to the shear plate, which cutting member is provided with cutting elements.

Such a shaving apparatus, which comprises a reciprocatory cutting member, is for example known from U.S. Pat. No. 3,967,374. With the construction described in such patent it may happen that as a result of the forces which occur during hair cutting the shear plate is locally lifted off the cutting member, which action has an adverse effect on the operation of the apparatus.

It is the object of the present invention to improve the operation of such a shaving apparatus and this leads to a construction which is characterized in that a cutting element is constituted by a filamentary cutter provided with a supporting lamella.

A preferred embodiment is characterized in that the filamentary cutter is of substantially triangular cross-section and is situated in a corresponding slot of the supporting lamella.

In addition an embodiment is possible which is characterized in that the filamentary cutter is at least partly situated between two supporting lamellae.

A special embodiment is characterized in that the supporting lamellae of the cutting member are provided with sharp contact edges.

The invention will now be described in connection with the accompanying drawings, in which.

Figure 1:
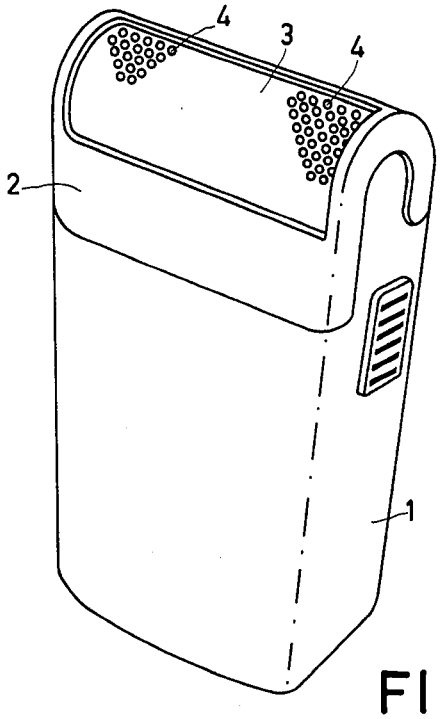
FIG. 1 shows a shaving apparatus in perspective.
Figure 2:
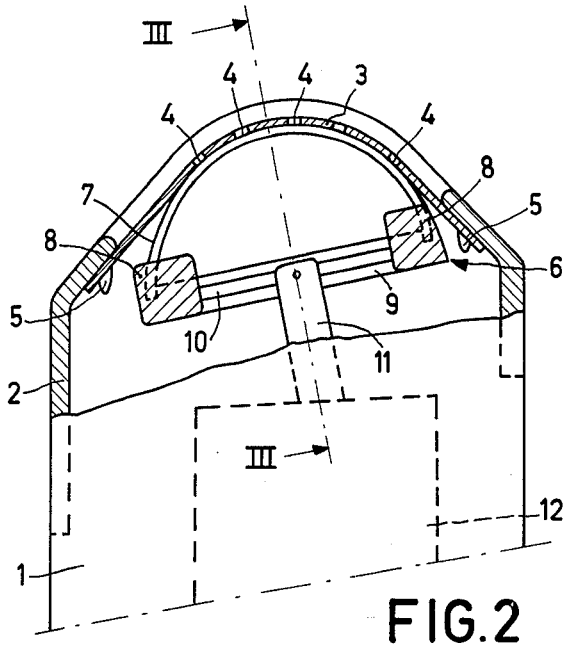
FIG. 2 shows the shaving apparatus of FIG. 1 on an enlarged scale partly in side view and partly in a cross-sectional view.
Figure 3:
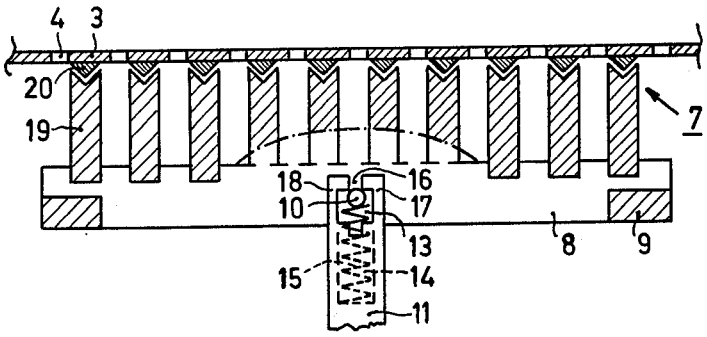
FIg. 3 is a cross-section taken on the line III—III in FIG. 2

The shaving apparatus in accordance with FIGS. 1 and 2 comprises a housing 1 with a detachable shaving head 2. The shaving head 2 is provided with a shear plate 3 having hair entry apertures 4. For the fixation of the shear plate 3 to the shaving head 2 said head is provided with hook-shaped projections 5, which engage with corresponding openings in the shear plate. On the inner side of the shear plate a cutting member 6 is situated which is drivable with a reciprocating movement relative to the shear plate. The cutting member 6 is provided with cutting elements 7, which at their inner edges are secured to the strips 8. These strips 8 are interconnected at their opposite ends by the cross members 9, so that a frame is formed which constitutes the basis of the cutting member. This frame 8, 9 is provided with a pin 10 for the coupling of the cutting member 6 to the vibrator motor 12 via the drive spindle 11 (also see FIG. 3). In the assembled condition the pin 10 engages the slot 13 at the end of the spindle 11. The cavity 14 in the spindle 11 accommodates a pressure spring 15, which is compressed between the spindle 11 and the pin 10, so that the cutting member 6 is urged against the inner side of the shear plate 3.

The slot 16 allows the ends 17 and 18 of the spindle 11 to deflect elastically, if for example a manual force is exerted on the cutting member in the longitudinal direction of the spindle 11. The pin 10 can then pass through the slot 16, so that the cutting member 6 can be fitted or removed in a simple manner.

Each cutting element 7 is constituted by a cutter 20 in the form of a filament or wire arranged along the outer edge of a lamelliform support 19. Parts 19 and 20 are secured at their respective inner edges and ends in the respective strips 8.

Figure 4:
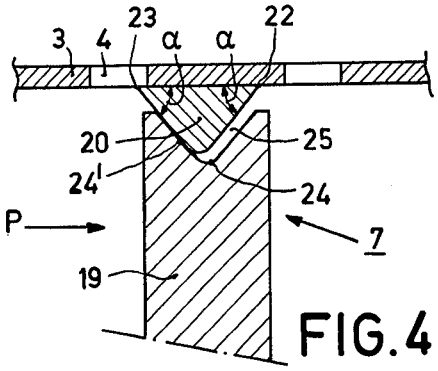
FIGS. 4 and 5 show a detail of the cross-section of FIG. 3 on an enlarged scale.
Figure 5:
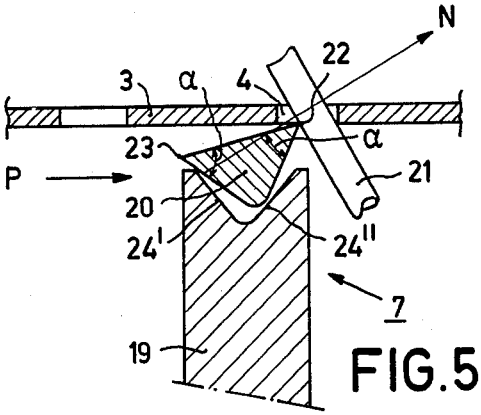

FIGS. 4 and 5 show a part of a cutting element 7 with the filamentary cutter 20 and the semi-circular rigid supporting lamelliform plate member 19 and also a part of the shear plate 3, whilst FIG. 5 moreover shows a hair 21 to be shaved. The filamentary cutter 20 is of triangular cross-section, so that it has cutting edges 22 and 23 on its opposite sides. The filamentary cutter 20 is positioned or situated in a groove or slot 24, which is also triangular, formed in the semi-circular edge of the supporting lamella 19. The length of the filamentary cutter 20 is greater than is necessary to ensure that the filamentary cutter in the slot 24 engages throughout with the supporting lamella 19, so that at least locally a slot-like clearance 25 is left between the filamentary cutter and the supporting lamella. The filamentary cutter 20, which is of course highly flexible, is thus capable of adapting itself to the shape of the shear plate 3, so that a correct engagement of the filamentary cutter with the shear plate is obtained. Owing to this high flexibility of the filamentary cutter 20 a smaller resilient force of the spring 15 is necessry for correct engagement with the shear plate 3 than for example in the case that the cutting elements are exclusively constituted by rigid disc-shaped bodies. This reduces the frictional loss between the cutting member and the shear plate.

In the direction P the filamentary cutter 20 is moved along by the supporting lamella 19, the wall 24' of the groove 24 engaging with the filamentary cutter. In the situation represented in FIG. 5 the cutting element 7 has reached a hair 21. The forces exerted on the cutting element 7 by the hair 21 when said hair is being cut, the so-called cutting forces, generally tend to lift the shear plate off the cutting member, which adversely affects the cutting action. The reaction force N exerted on the filamentary cutter 20 by the wall 24', which force is directed perpendicular to the wall 24' if the frictional forces between the filamentary cutter and the supporting lamella are neglected, has a component which is directed towards the shear plate, so that the filamentary cutter remains in engagement with the shear plate. The cutting edge 22 of the filamentary cutter 20 penetrates into the hair 21 and by cooperation between the filamentary cutter 20 and the shear plate 3 said hair is now cut in an efficient manner.

When the cutting member 6 is driven in the direction opposed to P, the filamentary cutter 20 will cut the hairs with the cutting edge 23 in a similar way. The filamentary cutter 20 then engages with the wall 24" of the groove 24.

As the filamentary cutter 20 is provided with the sharp cutting edges 22 and 23 defined by the acute angles $\alpha$, the prevailing cutting forces are substantially smaller than in the case of cutting elements with a cutting edge having a right angle.

Figure 6:
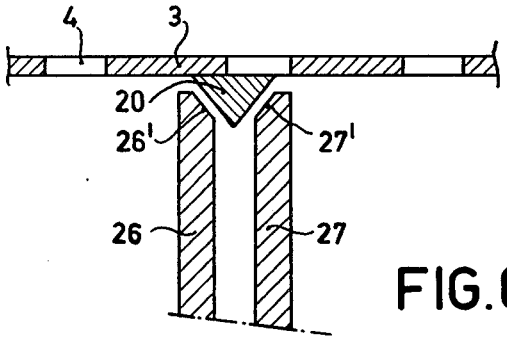
FIG. 6 shows a detail, corresponding to FIG. 4, of a different embodiment.

In the embodiment in accordance with FIG. 6 the filamentary cutter 20 is situated between two spaced lamellae 26 and 27 comprising the lamelliform support.

During operation of the apparatus the filamentary cutter 20 alternately engages with the oblique wall portions 26' and 27' of these supporting lamellae. Furthermore the operation is identical to that of the embodiment in accordance with FIGS. 4 and 5.

Figure 7:
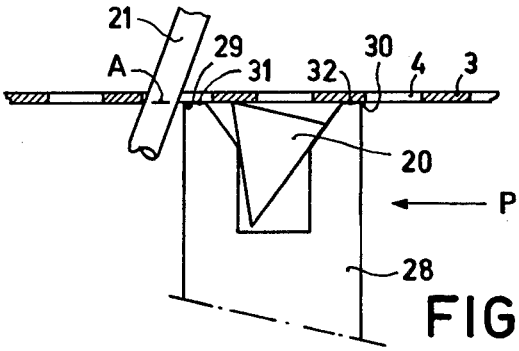
FIGS. 7 and 8 show details, corresponding to FIGS. 4 and 5, of still another embodiment.
Figure 8:
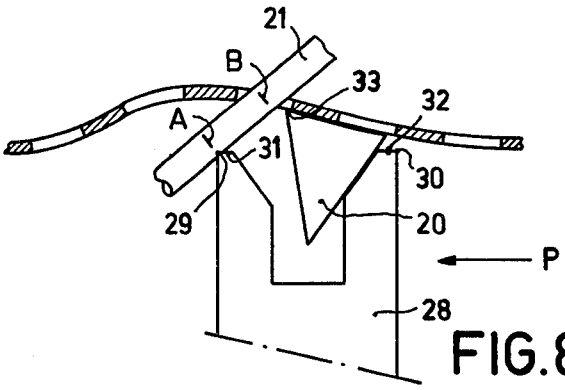

In the embodiment in accordance with FIGS. 7 and 8 the supporting lamella 28 is provided with sharp contact edges 29 and 30. In the situation in which no hair 21 has been reached yet (FIG. 7) the supporting lamella 28 normally engages the shear plate 3 with its walls 31 and 32. When the supporting lamella 28 reaches the hair 21 the contact edge 29 will slightly penetrate into the hair at the location A, so that the hair is moved along in the direction of movement P (FIG. 8). The cutting forces which occur will tend to lift the shear plate 3 off the supporting lamella 28. However, for the same reason as set forth in the description of the embodiment of FIGS. 4 and 5 the filamentary cutter 20 will remain in engagement with the shear plate. Thus, the filamentary cutter 20 acts on the hair 21 with the cutting edge 33 at the location B and the hair will be cut at this location by cooperation of the filamentary cutter 20 and the shear plate 3. In this way, a length of the hair 21 will be cut which is roughly an amount AB greater than in the case of a conventional cutting element, which for example only comprises a single disc, yielding a better shaving result.

Although only embodiments of shaving apparatus with reciprocating cutting members have been described, the invention may also be used in conjunction with a shaving apparatus with rotating cutting members.

The filamentary cutter may alternatively be of semi-circular or other cross-section.

What is claimed is:

1. A shaving apparatus comprising a shear plate with hair entry apertures; a cutting member associated with and reciprocatory relative to the shear plate, said cutting member including a frame formed from longitudinally extending oppositely disposed strips interconnected at their opposite ends by cross members; and cutting elements extending from said cutting member toward the shear plate, each cutting element being constituted by a semi-circular rigid supporting lamelliform plate member secured in the oppositely disposed strips, a groove being formed in the semi-circular edge of the lamelliform plate member facing the shear plate, and a single cutter in the form of a filament positioned in said groove and secured at its ends to said oppositely disposed strips, said filamentary cutter being in contact with said shear plate.

2. A shaving apparatus according to claim 1, in which the filamentary cutter has a substantially triangular cross section and is in contact along its base with the shear plate.

* * * * *